US005432957A

United States Patent [19]

Fernie et al.

[11] Patent Number: 5,432,957

[45] Date of Patent: Jul. 18, 1995

[54] CONVERSION KIT FOR TOILETS FOR VARYING SHAPES

[76] Inventors: Geoffrey R. Fernie, 29 Blaketon Road, Islington, Ontario, Canada, M9B 4W4; Brian P. Doyle, 36 High Park Blvd., Toronto, Ontario, Canada, M6R 1M8; Christine G. Kronich, 215 Tanglewood La., Sheboygan, Wis. 53081

[21] Appl. No.: 186,033

[22] Filed: Jan. 25, 1994

[51] Int. Cl.[6] ..... E03D 11/16

[52] U.S. Cl. ..... 4/252.4; 4/252.1; 4/254

[58] Field of Search ..... 4/254, 252.1, 252.4, 4/252.5, 667, 252.2, 252.3; 285/56-60

[56] References Cited

U.S. PATENT DOCUMENTS

| | | | |
|---|---|---|---|
| 1,533,444 | 4/1925 | Mohr | 4/252.5 |
| 3,048,853 | 8/1962 | Litzkow | 4/252.2 |
| 3,263,244 | 8/1966 | Kutz | 4/252.4 |
| 3,360,805 | 1/1968 | Aumann | 4/252.4 |
| 3,896,510 | 7/1975 | O'Connell | 4/252.4 |
| 4,515,398 | 5/1985 | Machon, Sr. | 4/252.5 |
| 4,631,759 | 12/1986 | Strasser | 4/254 |
| 4,637,079 | 1/1987 | Hodge | 4/252.4 |
| 4,974,653 | 1/1989 | Strasser | 4/254 |
| 5,167,040 | 12/1992 | Lechner | 4/252.2 |

*Primary Examiner*—Henry J. Recla
*Assistant Examiner*—Gregory M. Vidovich

[57] ABSTRACT

A toilet conversion kit for toilets of various shapes, the kit having a base which can stand on the floor around a soil pipe and an upper surface for supporting the toilet, and having first and second end wall profiles. An elongated axial opening extends from a point adjacent one end, for a distance along the length of the base, and can register with the soil pipe. There are a plurality of fastening openings in, the base alongside either side of the opening. A soil pipe extension separate from the base, defines a generally tubular shape having upper and lower ends, a soil pipe connection at its lower end, a toilet connection member at its upper end, and fastenings formed with the upper end of which can be fastened to the fastenings of the base. The upper end of the extensions interfits with the elongated opening in the base. In this way the soil pipe extension may be moved along the length of the opening, and fastened to the base at selected locations therealong, so that the toilet conversion kit can be used with a wide variety of a different toilet appliance designs, with one end profile of the base conforming as closely as possible to the shape of the stand of the toilet appliance.

8 Claims, 5 Drawing Sheets

CONVERSION KIT FOR TOILETS FOR VARYING SHAPES

FIELD OF THE INVENTION

This invention relates to a conversion kit for raising the height of flush toilet seats for use with flush toilets, of various shapes and designs.

BACKGROUND OF THE INVENTION

The standard height above the floors of the seat of flush toilet is around 14 inches. For various purposes especially for use by invalids and persons confined, or partially confined, to a wheel chair it is desirable to raise the seat height somewhat. For such persons the most suitable seat height of a toilet may be such that the toilet seat is level with the seat of a wheel chair. For other purposes the toilet height may be less than the height of the wheel chair seat but higher then the height of the conventional toilet seat. For example, for some disabled persons e.g. those with arthritis who are at least partially ambulatory, a slightly higher toilet seat may be desirable so that they may descend to and rise from a sitting position more easily.

Specially designed toilets are available in which the seats are higher than standard level toilet seats. Such toilets for example of, say, 18 inches in height, are often provided with side rails or arm rests which, while being movable into or out of position, may be either an integral part of the toilet or a fixed fitting around it. Such toilets and their associated guard rails or arm rests may be very expensive and unattractive. They are generally unsuitable for installation in a private house in which it may be especially desirable to provide a toilet with a higher seat having a generally aesthetic appearance.

Usually toilets designed for the use of wheel chair patients have a seat level of about 18 inches, or generally similar to that of a wheel chair. Thus a wheel chair patient may draw the wheel chair alongside and lever himself from the chair seat to the toilet seat. However, such toilets of wheelchair seat level may not be suitable for ambulatory disabled persons who do not require such a high seat. (In this specification a person or patient will be referred to in the masculine for simplicity. All statements are intended to apply to persons of either sex). In the domestic environment the institutional type raised toilets are unsightly expensive and unsuitable.

Arm rests have always presented a problem of fitting securely while allowing easy access of a wheelchair due to the difficulty in fitting them securely in positions where they are useful, and also in providing suitable means for removing them when not required.

The present invention addresses the problems of providing elevated toilet seat facilities whether in a domestic environment or in a hospital or other public facilities, at a reasonable cost and which may be utilized with a variety of different standard toilet appliances of varying shapes.

By providing what is an essentially universal conversion kit, which is adaptable to substantially all standard makes and designs of toilet appliances, it becomes possible to manufacture the conversion kit in large volumes in a single design, which thus enables the conversion kit to be mass marketed at a reasonable price to the consumer, and reduces problems of distributors stocking numerous different designs and shapes of conversion kits to accommodate different shapes and designs of toilet appliances.

It must be born in mind that within the industry, there are many different toilet appliance manufacturers, and each manufacturer may manufacture a range of different designs of toilet appliance. Each toilet appliance may have a different "footprint". It will thus be apparent that the design of a universal conversion kit which is adaptable to substantially all of such toilet appliance designs of all major manufacturers in the market place presents something of a challenge.

Even in this case it will be appreciated that when referring to "all" designs, it will be apparent that there may be a few unusual designs either of domestic manufacturers or of foreign manufacturers which cannot be accommodated in a universal conversion kit. However, the likelihood of such few unusual designs being outside the scope of the universal conversion kit of the invention is not seen as a problem. Where a person wishes to employ the universal conversion kit of the invention, and finds that his home has one of the very few unusual designs with which the conversion kit is not applicable, it will generally speaking be simpler, and cheaper, for him to simply buy a new toilet appliance of a more standard design, which is probably relatively inexpensive, compared with the unusual design he may have in the house at the moment, and he will then be able to employ the universal conversion kit of the invention. He will thus be able to gain the benefits of the invention at a minimal additional cost.

BRIEF SUMMARY OF THE INVENTION

According to the invention there is provided a toilet conversion kit for toilets of various shapes and comprising a base member adapted to stand on the floor around the soil pipe and having an upper surface for supporting the toilet, and defining first and second end wall profiles extending from said upper surface to said floor, an elongated axial opening extending from a point adjacent one said end, for a distance along the length of said base, said elongated axial opening being adapted to register with said soil pipe, a plurality of fastening openings in said base alongside either side of said axial opening at spaced intervals, a soil pipe extension separate from said base, defining a generally tubular shape having upper and lower ends, soil pipe connection means at said lower end of said soil pipe extension, toilet connection means at said upper end, fastening means formed integrally with said upper end of said soil pipe extension, and adapted to be fastened to said fastening means of said base member, and at least said upper end of said base member being adapted to interfit with said elongated opening in said base member, whereby said soil pipe extension may be moved along the length of said elongated axial opening, and fastened to said base member at selected locations therealong, whereby said toilet conversion kit may be adapted for use with a wide variety of a different toilet appliance designs, with one said end profile conforming as closely as possible to the shape of the stand of said toilet appliance.

Other features of the invention include seal retaining means at said lower end of said soil pipe extension, and further seal retaining means at said upper end of said soil pipe extension.

The invention may also be provided with hand rail attachment means, preferably in the form of recesses formed in the sides of said base member, and extending thereacross.

Preferably in order that the hand rail supports are located rearwardly of the toilet, there will be a plurality, for example two such recesses on each side of the base so that the base may be used either way around.

Preferably there will be two hand rail support columns attached to the base member on either side, and the hand rails will be attached to the upper ends of the columns.

In most cases the base members will be made of a standard height so as to elevate the toilet seat to wheel chair height, i.e., typically about 18 inches. However, it is within the scope of the invention that further spacers may be provided, so as to raise the toilet still further in certain cases. In these cases typically the soil pipe extension would be longer, or alternatively an additional soil pipe sub-extender would be provided with connections at both ends which could thus be connected to the existing soil pipe extender to provide greater height.

However, in most cases this would not be required since the standard height usually required is wheel chair height.

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

Figure 1:
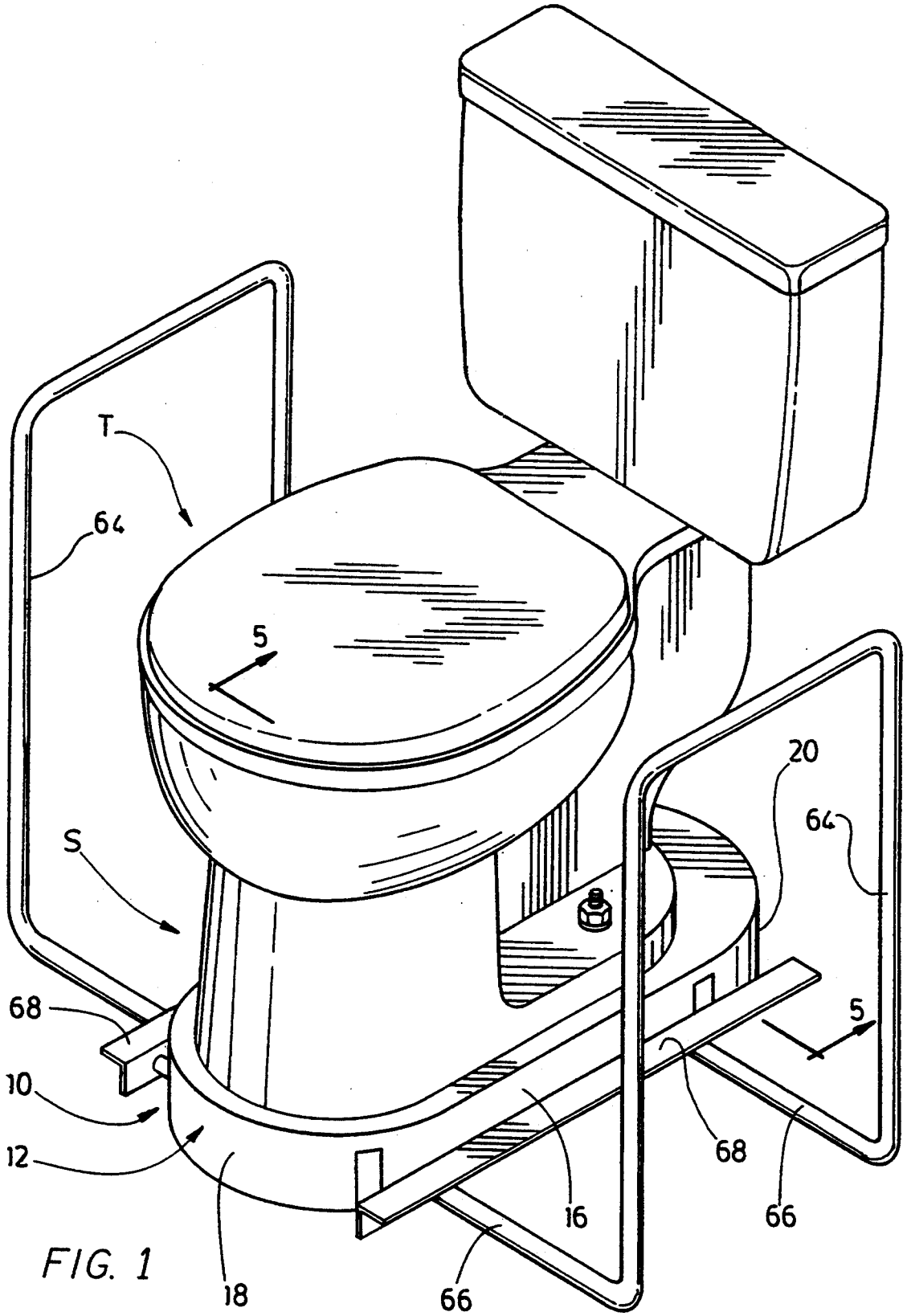
FIG. 1 is a perspective illustration of a toilet shown in position on a toilet conversion kit illustrating a preferred embodiment.

Referring first of all to FIG. 1, it will be seen that the invention is illustrated here in an embodiment of a conversion kit for a toilet, the kit being illustrated generally as 10.

It is shown in position underneath a toilet appliance, T.

The toilet T, may be one of many different designs by many different manufacturers, and has a lower stand portion S which is normally adapted to stand on the floor around the soil pipe.

The stand portion S of the toilet appliance T defines what may be termed a "footprint" or a distinctive outline or profile. Such a footprint may vary from one design of toilet appliance to another.

Before describing the kit, 10 in detail, it will be observed that in order to avoid obstructing the floor around the stand S of the toilet, it is desirable that at least the front profile of the kit shall conform more or less as closely as is possible to the front profile of the stand itself.

These are merely preliminary remarks, and as will become apparent as this description proceeds, the invention is directed towards achieving as close as possible conformity between the profile of the kit and the profile of the toilet stand, even over a relatively broad range of different makes and designs of toilets.

It will also be observed that the kit 10 has raised the toilet a predetermined distance above the floor, defined by the height of the kit.

Typically, the kit will have a height of about 4 to 5 inches so as to elevate the toilet from the normal standard toilet height which is around 14 inches to somewhere about 18 inches or slightly more.

Figure 2:
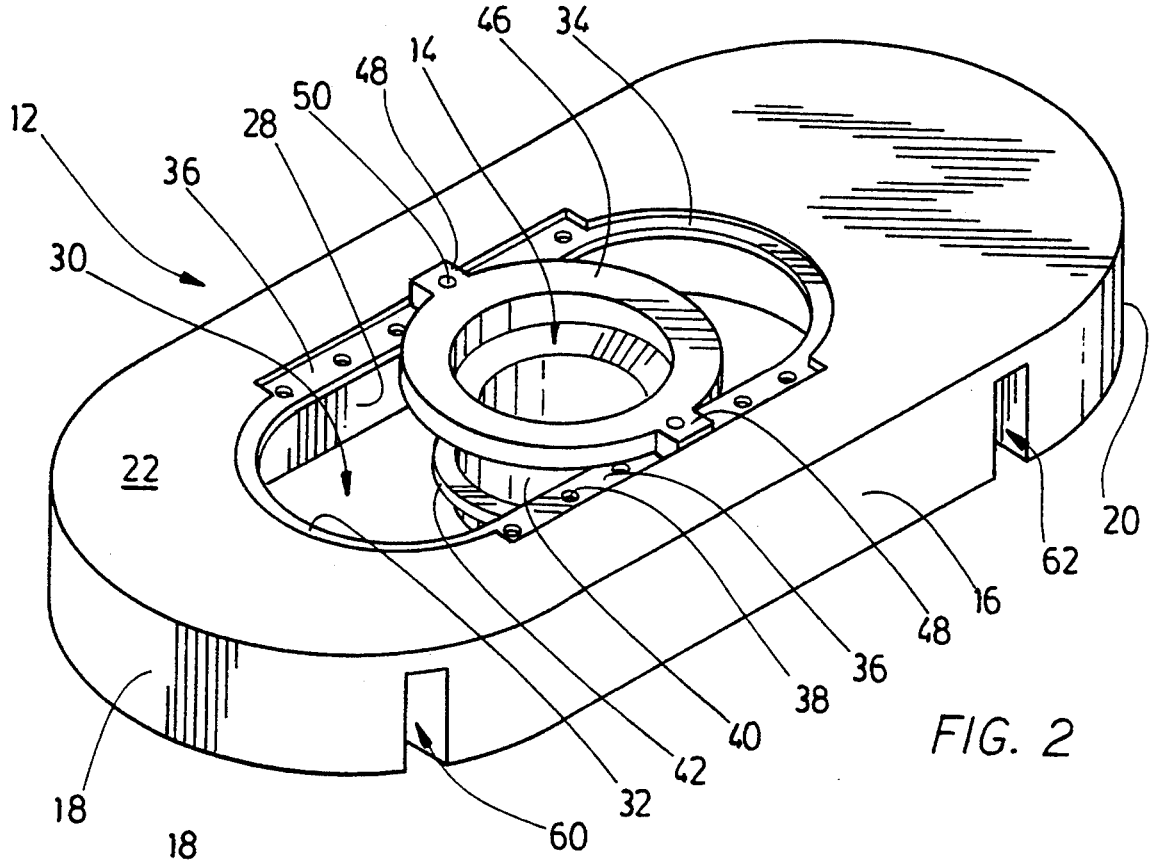
FIG. 2 is an upper perspective illustration of the conversion kit.
Figure 3:
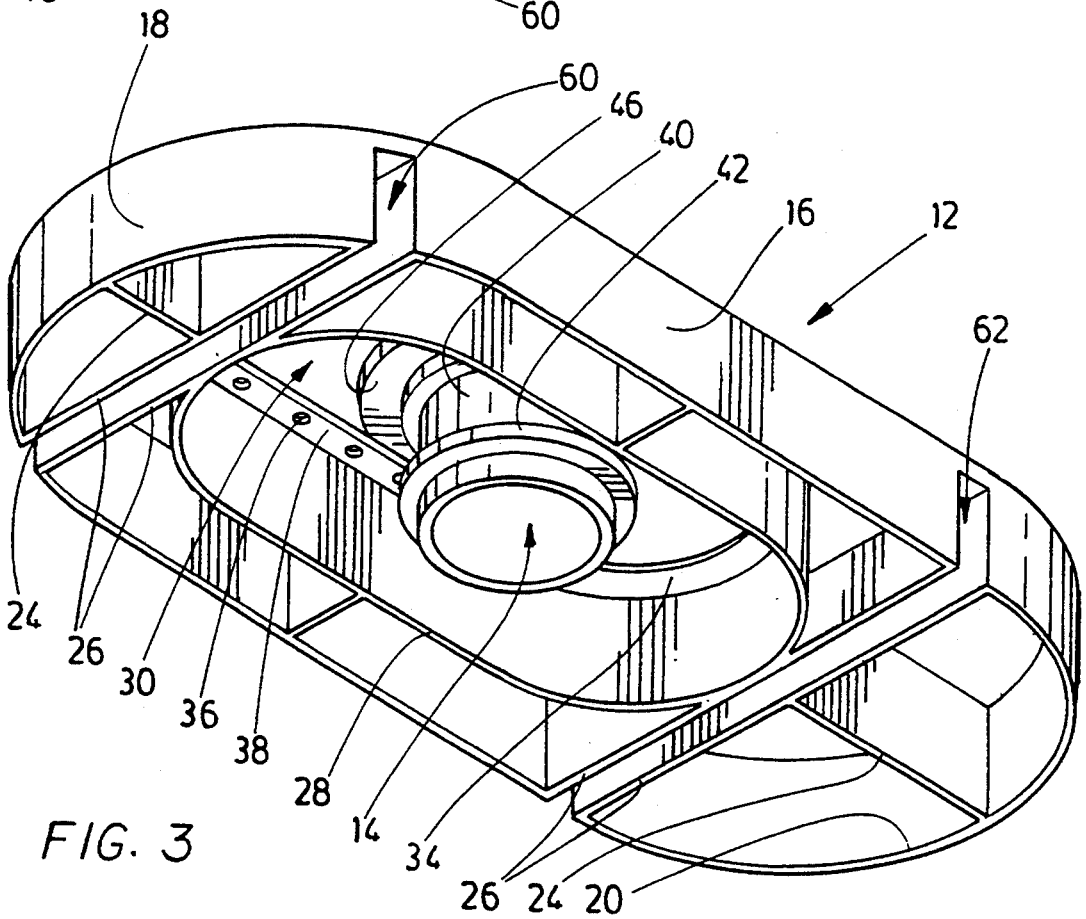
FIG. 3 is a lower perspective illustration of the toilet conversion kit.
Figure 4:
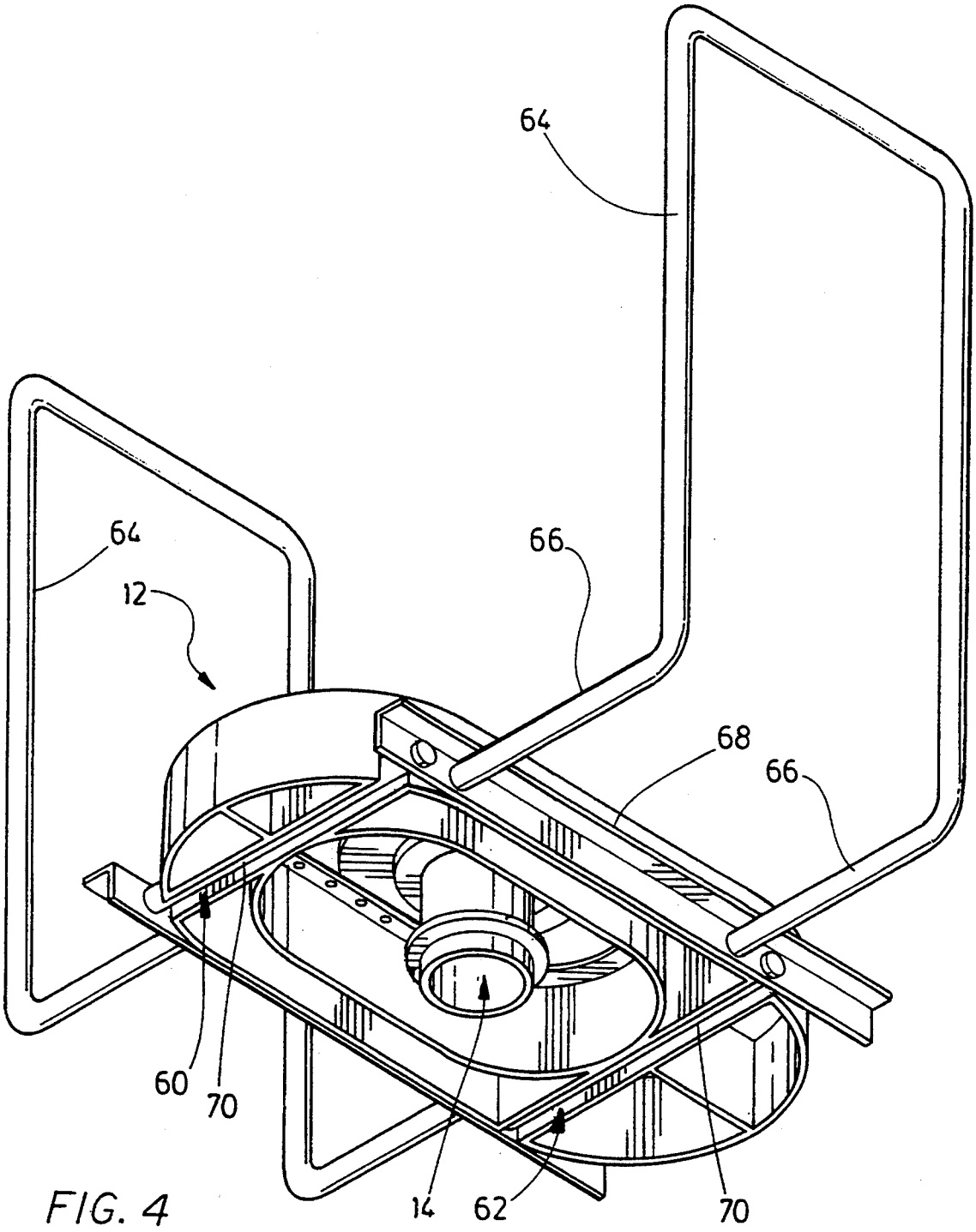
FIG. 4 is a lower perspective of the toilet conversion kit, showing hand rails attached thereto.

Referring now to FIGS. 2, 3 and 4 it will be seen that the kit 10 comprises a hollow base 12, and a separate soil pipe extension 14.

The base 12 comprises a perimeter 16 wall having generally curved ends 18 and 20. Supported by the perimeter wall is a top panel 22 which is generally planar and is adapted to support the toilet appliance T as shown in FIG. 1.

Within the perimeter wall 16 there are provided longitudinal support walls 24 extending parallel to the longitudinal axis of the base 10, and a plurality of transverse support walls 26 extending from either side transversely.

The support walls extend upwardly and merge with the underside of the top panel 22. Thus the support walls together with the perimeter wall define a structure of great strength, adapted to support the weight of the toilet, and a person upon it.

Extending between the longitudinal walls 24 and the transverse walls 26 is a continuous generally oval-shaped interior support wall 28.

The top panel 22 is provided with an elongated axial opening 30 within support wall 28 extending along the longitudinal axis of panel 22 and having first and second generally curved end walls 32 and 34. Linear side flanges 36 extend between the curved end walls.

Along each of the linear side flanges 36, there are formed a plurality of fastening openings 38 at spaced intervals.

It will be observed that the profile of the curved end walls 18 and 20 of the perimeter wall 16 are essentially the same at both ends of the base 10.

However, it is conceivable that the profiles of walls 18 and 20 might be varied so that at one end of the profile is different from the other, for reasons to be described below.

It will also be noted that the elongated axial opening 30 is offset along the longitudinal axis of the base 12 so that one end of the elongated axial opening commences more or less adjacent to the one peripheral end wall 18, and the other end of the elongated axial opening terminates at a point intermediate between the two end walls 18 and 20 of the base 12.

As will become apparent from the following description, this feature enables the base to be used "either way around" so as to accommodate a wide variety of varying toilet appliance designs having varying "footprints".

It will also be appreciated that the base 12 may be manufactured by injection moulding techniques, out of any suitable thermo-plastic material having appropriate structural properties.

In order to connect the toilet appliance T to a soil pipe in the floor, a soil pipe extension 14 is provided, which is separate from the base 12.

The soil pipe extension 14 comprises a generally tubular member having a more or less cylindrical tube wall 40. The lower end of the tube 40 is formed with an annular sealing flange 42 extending integrally outwardly therefrom spaced upwardly from the lower extremity of the tube 40 which forms a connection means for a plumbing soil pipe P (FIG. 5).

At its upper end, the tube 40 is formed integrally with an outwardly extending annular support flange 46. Two fastening tabs 48 extend outwardly from the annular support flange, and have fastening openings 50 formed therethrough.

The tabs 48 are adapted to be received on the linear support flanges 36 of the base 12, and the openings 50 in the tabs are adapted to register with the openings 38 in the linear flanges 36, so that suitable fastenings can be passed through both openings 50 and 38, thereby fastening the soil pipe extension to the base member 12 at various different positions, along the longitudinal axis of the opening 30.

Figure 5:
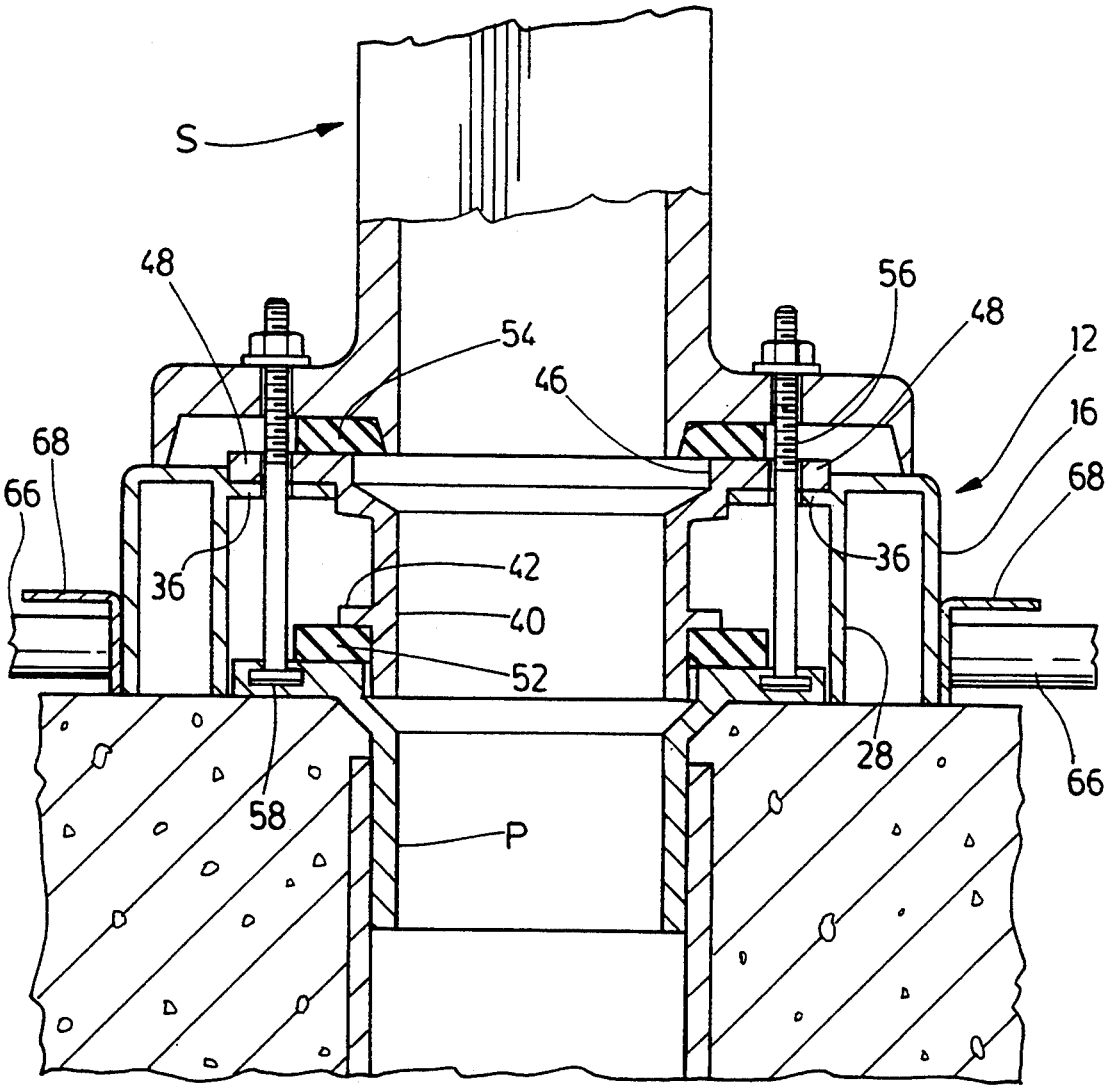
FIG. 5 is a section along the line 5—5 of FIG. 1, and, FIG. 6 is an exploded perspective.
Figure 6:
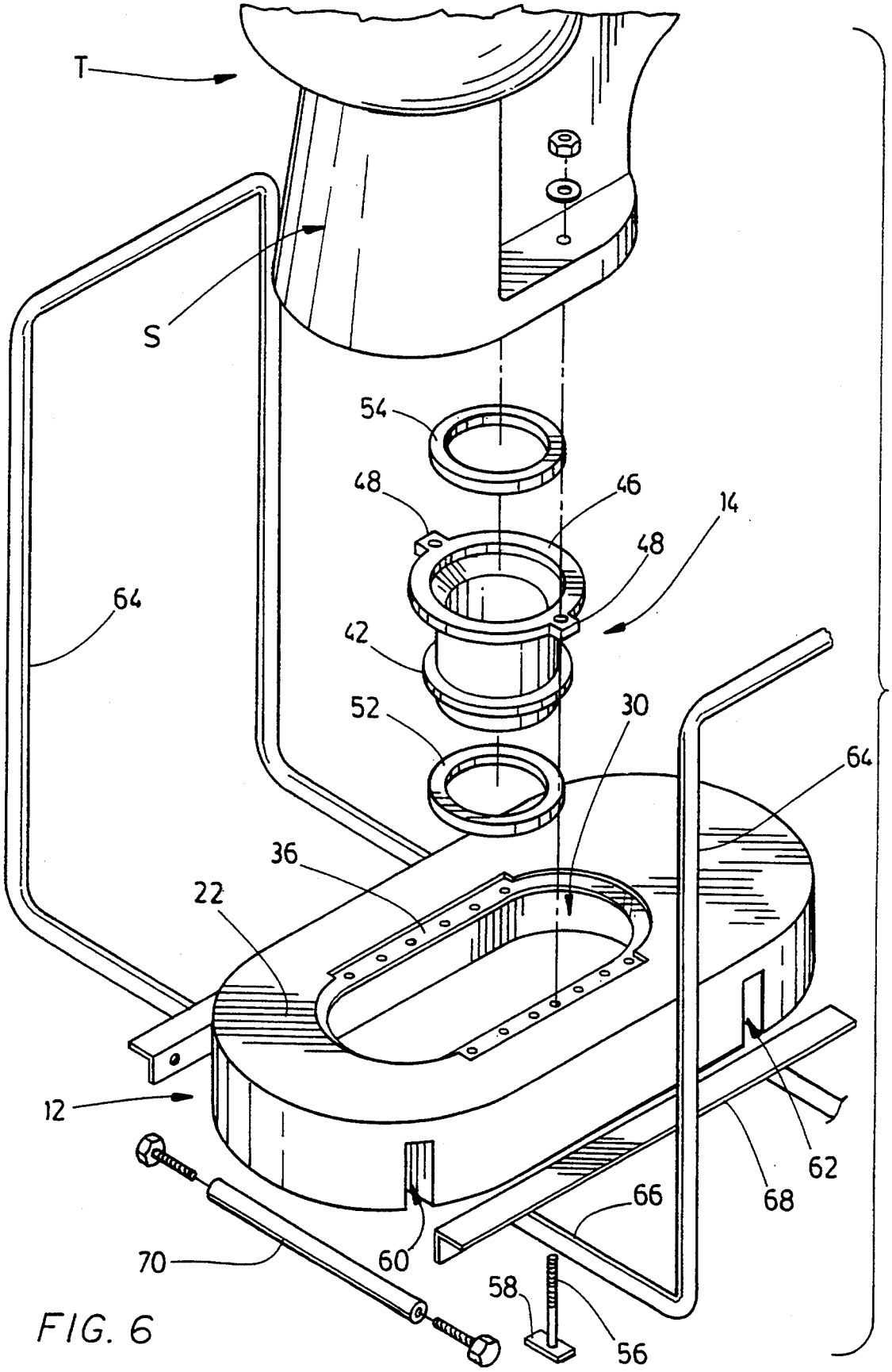

Referring now to FIG. 5, the kit is shown installed, with suitable seals 52 and 54 at the lower and upper ends of the soil pipe extension 14. The upper end of the plumbing soil pipe P is itself shown, and the lower portion of the stand S of the toilet appliance T is shown partially cut away.

The seals 52 and 54 are typical plumbing drain seals used in such situations consisting of an annular ring of resilient compressible material usually foam rubber or plastic, and shaped so as to have a profile permitting interfitting of the soil pipe extension at it's lower end with the plumbing soil pipe P at it's upper end so as to receive the downwardly extending pipe of the stand S of the conventional toilet T. The bolts 56 by means of which the toilet is secured to the soil pipe will be supplied with the kit. Clearly, they are longer than conventional fastening bolts by an amount equal to the height of the base. As is well known, such bolts have bolt heads 58 of generally T shaped design, fitting in suitable slotted openings of known design in the flange of the plumbing soil pipe P, of the typical domestic plumbing installation.

The upper ends of the bolts are threaded to receive suitable threaded fastenings in a manner well known in the plumbing art.

Thus by tightening down the threaded fastenings, the toilet T can be securely and firmly pressed downwardly onto the panel 22 of the base, and at the same time compressing both the seals 52 and 54 at both ends of the soil pipe extension 14 to achieve a good liquid tight union.

It will be appreciated, that in use, the kit is first of all compared with the design of the stand portion S of the toilet T and the location of the toilet plumbing soil pipe. The base 12 is then rotated to the most convenient orientation, either with the elongated axial opening 30 forwardly, or with the opening 30 being located rearwardly. The soil pipe extension 14 is then placed in position in the appropriate location registering with the desired openings 38 in the flanges 36 of the base 12.

The toilet seals 52 and 54 will have been placed in position on the lower and upper ends of the soil pipe extension 14, and the toilet is then placed in position. The bolts 56 will previously have been secured in the flange of the plumbing soil pipe P in known manner, and will have been led up through the appropriate openings 38 in the base 12, and through the soil pipe extension tabs 48.

The toilet will then be lowered down into position over the bolts 56 and will be firmly secured by means of threaded securing devices in a manner well known in the art. It will thus be seen that by use of the kit in accordance with the invention, a high degree of conformity may be achieved by the front profile of the stand S of the toilet T, and one of the curved perimeter end walls 18 or 20, at one end, or at the other end, of the base 12, depending upon which of the end walls is rotated forwardly.

It will also now be appreciated that by the use of the separate base 12 and soil pipe extension 14, the soil pipe extension itself 14, which becomes part of the plumbing system of the house, and is therefore subject to municipal provincial and state building codes and regulations, can be manufactured of an appropriate grade of plumbing plastic material of an appropriate thickness so as to meet all such regulations and codes. The base 12 itself may be made of any thermoplastic material suitable for carrying the anticipated loads, but in respect of which there are no building regulations, which might impose uneconomical restrictions or requirements.

In order to provide for the attachment of the handrail, the base 16 defines two parallel transverse through openings 60 and 62, defined between respective pairs of transverse support walls 26-26. Hand rails may be attached to the base, for example by providing a tubular U-shaped hand rail 64, bent to provide an upper horizontal portion and two lower horizontal portions. The lower horizontal portions 66 may be secured to, for example, a fastening bar 68 for example by welding or the like.

Threaded fastening devices 70 may be attached to the bars 68, and are dimensioned so as to extend through respective openings 60 and 62.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A toilet conversion kit for use in association with various toilet appliances of the type adapted to be connected to a plumbing soil pipe, said toilet appliances having a stand portion defining front and back surfaces of various shapes, said kit comprising;

a base member having first and second ends defining length and breadth and adapted to stand on the floor around a plumbing soil pipe and having an upper surface for supporting the toilet appliance, and a lower surface, and defining first and second end wall profiles at said first and second ends, respectively, extending from said upper surface to said floor for spacing said lower surface above and out of contact with said floor;

an elongated axial opening in said upper surface extending from a point adjacent one of said end wall profiles, for a distance along the length of said base member, said elongated opening being adapted to register with said soil pipe;

at least one longitudinal support wall substantially along the length of said base member in connection with said lower surface of said base member and transverse support walls in connection with said lower surface of said base member, normal to said at least one longitudinal support wall, extending across said lower surface of said base member from side to side;

a support wall in connection with said lower surface of said base member registering with said elongated opening, and having side wall portions and curved end wall portions in connection with said lower surface of said base member and adapted to support said base member above said floor;

a soil pipe extension separate from said base member, defining a generally tubular shape having upper and lower ends adapted to be received directly in said elongated opening, and adapted to be positioned therein at various locations therealong;

a plurally of pairs of soil pipe extension fastening means comprising a plurality of apertures located alongside both sides of said elongated opening in said base member at spaced intervals therealong, said soil pipe extension being attachable to at least one of said apertures on both sides of said elongated opening;

plumbing soil pipe connection means at said lower end of said soil pipe extension whereby said soil pipe extension is adapted to be connected to said plumbing soil pipe;

toilet appliance connection means at said upper end of said soil pipe extension whereby said upper end is adapted to be connected to said toilet appliance, and, means for securing said soil pipe extension relative to said soil pipe extension fastening means of said base member, and said soil pipe extension being attachable at various locations along the length of said elongated opening whereby said base member is adapted to be positioned with a selected one of either said first or said second end walls adjacent said front surface of said toilet appliance stand portion.

2. A toilet conversion kit as claimed in claim 1 and wherein said soil pipe extension fastening means is formed integrally with said upper end of said soil pipe extension, and said upper end of said soil pipe extension being adapted to interfit with said elongated opening in said base member, whereby said soil pipe extension is adapted to be positioned along the length of said elongated opening in said base member, and fastened to said base member, at said various locations therealong whereby said toilet conversion kit is adapted for use with one of a wide variety of a different toilet appliance designs, with one of said end profiles conforming as closely as possible to the shape of the stand portion of said one toilet appliance design.

3. A toilet conversion kit as claimed in claim 1 including lower and upper seals, and further including seal retaining means at said lower end of said soil pipe extension, for retaining said lower seal and seal engaging means at said upper end of said soil pipe extension for engaging said upper seal.

4. A toilet conversion kit as claimed in claim 1 including hand rail attachment means formed in said base member.

5. A toilet conversion kit as claimed in claim 1 further including two hand rail support columns attached to said base member and hand rails at the upper ends of the columns.

6. A toilet conversion kit as claimed in claim 1 wherein said base member defines transverse through openings extending from side to side thereof.

7. A toilet conversion kit as claimed in claim 6 and including handrail attachment means adapted to extend through said through openings, whereby to secure handrails on at least one side of said base member.

8. A toilet conversion kit as claimed in claim 1 and further including a perimeter wall formed integrally with said base member and defining first and second curved end walls, in turn defining said first and second end wall profiles.

* * * * *